United States Patent [19]

Kelsall

[11] Patent Number: 4,965,968

[45] Date of Patent: Oct. 30, 1990

[54] BLAST CLEANING

[75] Inventor: Thomas W. Kelsall, Bradford, England

[73] Assignee: Kue Engineering Limited, Bradford, England

[21] Appl. No.: 390,498

[22] Filed: Aug. 1, 1989

Related U.S. Application Data

[63] Continuation of Ser. No. 942,416, Oct. 31, 1986, abandoned.

[30] Foreign Application Priority Data

Mar. 2, 1985 [GB] United Kingdom ..... 8505429

[51] Int. Cl.[5] ..... B24C 3/00

[52] U.S. Cl. ..... 51/410; 51/436; 51/320; 134/7

[58] Field of Search ..... 51/292, 319, 320, 321, 51/322, 410, 428, 436, 438; 134/7, 12, 13

[56] References Cited

U.S. PATENT DOCUMENTS

| | | | |
|---|---|---|---|
| 2,543,344 | 2/1951 | Tutsch . | |
| 2,815,716 | 12/1957 | Ransohoff . | |
| 3,074,822 | 1/1963 | Walk et al. | 134/7 |
| 3,389,507 | 6/1968 | Flaig | 51/436 |
| 3,676,963 | 7/1972 | Rice et al. | 51/320 |
| 4,389,820 | 6/1983 | Fong et al. | 51/320 X |
| 4,517,774 | 5/1985 | Dudding | 51/319 X |
| 4,519,812 | 5/1985 | Brull et al. | 51/322 X |
| 4,655,847 | 4/1987 | Ichinoseki et al. | 51/320 X |

FOREIGN PATENT DOCUMENTS

| | | | |
|---|---|---|---|
| 2638323 | 3/1978 | Fed. Rep. of Germany . | |
| 2475425 | 8/1981 | France | 51/320 |
| 223563 | 12/1983 | Japan | 51/320 |
| 5924961 | 2/1984 | Japan . | |
| 1538433 | 1/1979 | United Kingdom . | |
| 2145643 | 4/1985 | United Kingdom . | |

*Primary Examiner*—Frederick R. Schmidt
*Assistant Examiner*—M. Rachuba
*Attorney, Agent, or Firm*—Klauber & Jackson

[57] ABSTRACT

In contrast with the known method of cleansing surfaces by the projection of sand particles in an air stream against the surface, the present invention proposes to project particles of ice or other frozen liquid at the surface with the result that the spent particles will thereafter melt at the ambient temperature and be readily removed from the site and separated, if necessary, from contaminants dislodged from the surface.

Apparatus according to the invention comprises means for the introduction of ice particles continuously into a stream of pressurised air, preferably mixed with water. The means may comprise a plurality of containers, each successively passing between a position where they receive ice particles from a supply and a position where they release the particles to the stream.

9 Claims, 2 Drawing Sheets

BLAST CLEANING

This application is a continuation of application Ser. No. 942,416, filed Oct. 31, 1986.

BACKGROUND OF THE INVENTION

The invention relates to blast cleaning, particularly but not exclusively of surfaces contaminated by radioactive substances.

OBJECTS AND SUMMARY OF THE INVENTION

The technology of wet blast cleaning of surfaces of industrial and other plant, equipment and buildings using sand or other inorganic particulate materials as abradants has been developed to a stage where considerable cleansing effect can be accomplished with a minimum of abradant. When the contaminants to be removed are non-hazardous, this quantity of abradant presents no significant problem; if this is of sand, for example, it is inexpensive and relatively easy to dispose of. However, when hazardous contaminants such as radioactive substances are involved and stringent precautions have to be taken in the disposal of the abradant, even the minimum quantities referred to present considerable difficulties, and the present invention is concerned at least in part in reducing those difficulties.

According to one aspect of the invention there is provided a method of removing contaminants from a surface comprising propelling particles of frozen liquid at the surface. The particles are perferably propelled in or alongside a fluid stream. The stream may be of air, preferably mixed with water, and it may be propelled from a nozzle at a pressure greater than atmospheric.

Preferably the frozen liquid is ice and the method is such as to allow the ice particles to be transferred from a supply into the stream substantially in a continuous flow. The air may be cooled and dried, and the water may be mixed with antifreeze or corrosion inhibitor or both before making contact with the ice. Before leaving the nozzle, the air and water may be at a pressure in the range 10 to 250 p.s.i.g. and preferably between 20 p.s.i.g. and 160 p.s.i.g.

According to a further aspect of the invention there is provided apparatus for removal of contaminants from surfaces comprising means for producing ice particles, means for introducing the particles into a fluid stream and means for conveying the stream to the surface.

Preferably the stream conveying means comprise means for pressurising a body of fluid, and pipe means terminating in a nozzle for projecting the fluid in a jet. The ice introduction means may comprise an auger and, furthermore, preferably comprise at least one container arranged for receiving a quantity of ice from a supply and subsequently releasing the said ice to the introduction means.

Preferably the said at least one container is arranged to be closed to the ice supply when it is open to the introduction means. The apparatus preferably comprises a plurality of containers, each passing in turn from a first position open only to the ice supply for receiving ice, to a second position open only to the introduction means for releasing ice therefrom. Each container may subsequently pass to a third position for discharging any ice not released to the introduction means.

BRIEF DESCRIPTION OF THE DRAWINGS

Embodiments of the invention will now be described by way of example and with reference to the accompanying drawings, of which.

DETAILED DESCRIPTION OF THE PREFERRED EMBODIMENTS

Figure 1:
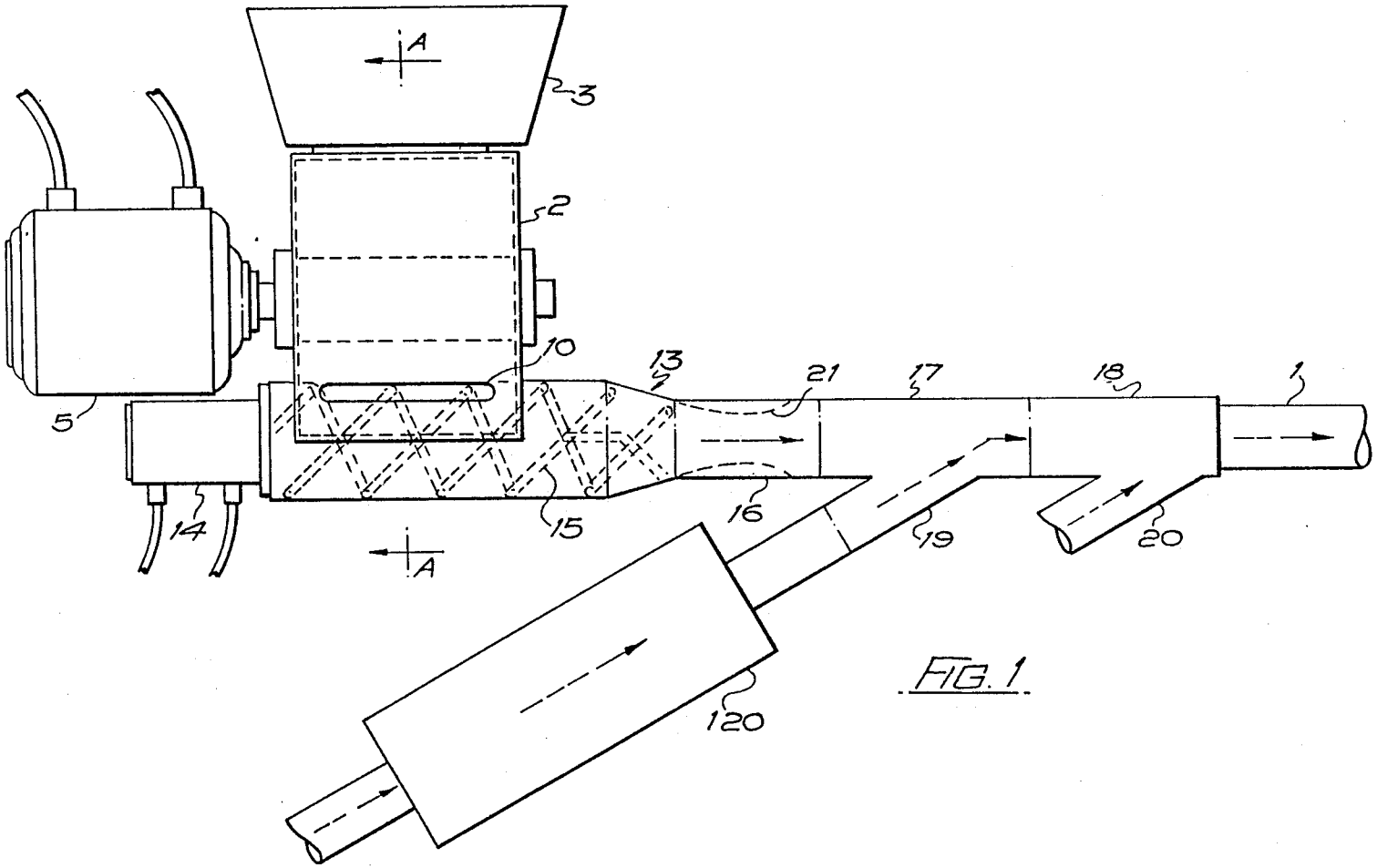
FIG. 1 is a schematic side elevation of an ice jet blast cleaning apparatus.

Sand of other mineral particulate solids have conventionally been used in blast cleaning, including wet blast cleaning, and the problems of dust and of the removal of the used abradant have been accepted hitherto as unavoidable and quite acceptable in view of the relative cheapness of the material. Indeed the disposal of the spent sand presents no significant difficulties when the cleaning is of surfaces contaminated with non-hazardous materials, but where extremely hazardous materials are concerned as in the refurbishing or nuclear installations, for example, the question of the disposal of the abradant becomes more serious because during the cleaning operation the contaminants are removed from the original surfaces and become admixed with the abradant. In the circumstances where radioactive materials are concerned, the contaminated abradant has to be handled with extreme care and disposed of under strictly controlled conditions. The difficulty and expense of such disposal completely overrides the convenience and cheapness of sand as abradant.

It has now been discovered that, with a suitable adaptation of the conventional blast cleaning equipment, hard ice particles may be used as abradant in dry and wet blast cleaning with the considerable advantage that the spent abradant will eventually melt and the contaminants may then be separated by filtration so that the resultant and relatively harmless filtrate may be readily disposed of.

Apparatus for use in connection with the method outlined above is shown in the figures and consists of a pressure hose 1 leading to a nozzle (not shown), to which hose compressed air, ice particles and optionally water are introduced to provide a fluid stream which issues from the nozzle in a jet.

The ice particles are produced by the use of a standard ice maker. This may be of drum and blade scraper configuration so as to produce particles of substantially regular size. As will be explained below, it is important that as far as possible the ice particles once formed shall not remain stationary and in contact with one another in case they begin to cohere under the influence of gravity. In an effort to maintain the separateness of the individual crystals, they are subjected to further cooling after production.

After cooling the particles are fed by gravity into a charging chamber via a chute 3. The charging chamber 2 consists of a cylindrical shell 4 and a rotor axially arranged within the shell and driven at controllable speed by suitable means such as an electric motor 5.

The rotor comprises a cylindrical core 6 from which a plurality of blades 7 project radially so as to contact the inner surface of the shell 4. According to requirements the blades may be fixed or spring loaded and the materials of construction of the blades and of the shell may be selected so that the blades form an effective pressure seal against the shell 4.

The shell 4 is provided with an inlet port 8 located below the chute 3 as well as outlet ports 9 and 10.

Figure 2:
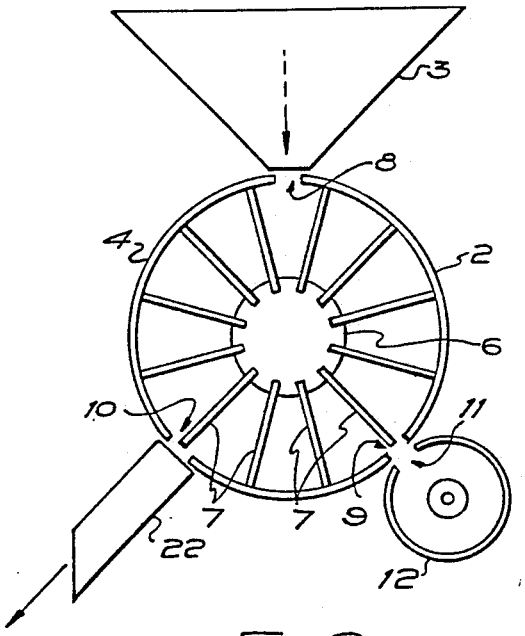
FIG. 2 is a section on line II—II of FIG. 1.

As the rotor is driven, in a clockwise direction as shown in FIG. 2, the blades 7 define, with the core 6 and the shell 4 a plurality of chambers which move cyclically between ports 8, 9 and 10.

The outlet opening 9 is arranged in alignment with the inlet opening 11 in the casing 12 of an auger 13. The auger is driven by a variable speed electric motor 14, and the auger screw 15 is so constructed in relation to the direction of rotation of the motor 14 that material entering into the casing 12 will be forced thereby towards the hose 1.

Between the hose 1 and the auger 13 there are a series of pipe elements 16, 17 and 18. Pipe element 17 has a branch 19 which is connected to a source of high pressure air (not shown) such as a conventional compressor unit operating in a pressure range between 10 and 250 p.s.i.g. and with a flow rate of between 50 and 500 cubic feet per minute. An air cooling and drying unit 120 is introduced into the air line between the source and the branch 19.

Pipe section 18 similarly has a branch 20 which leads to a source of water at a pressure in the range 10 to 250 p.s.i.g. and a valve, not shown, capable of adjusting the rate of flow of water into the pipe 18 from zero to twelve gallons per minute.

As shown in FIG. 1 the branch 19 is at an acute angle to the axis of the pipe element 17 so that air from the high pressure source is directed towards the hose 1. The flow of air from the branch towards the hose tends to cause a suction effect on the auger side of the pipe 17, and this effect is enhanced by providing pipe section 16 with an internal Venturi surface 21.

In use of the apparatus, ice particles produced by the ice maker and subsequently cooled are fed via the chute 3 so that they drop into one of the compartments in the charging chamber 2 defined between two blades 7. As the rotor is rotated at controlled speed within the shell 4 the chamber is closed by both blades 7 moving in sealed relationship with the inner surface of the shell until the leading blade passes the opening 9 when the ice particles, or some of them, fall under gravity through the opening 11 in the casing 12 of the auger 13.

The auger is being driven by the motor 14 and the ice particles are conveyed thereby towards the pipe element 16. During this period compressed, cooled and dried air is being introduced into the pipe element 17 via the branch 19 towards the hose 1, and the pitot effect of the air flow is such that, urged also by the auger 13, the ice particles are drawn into the air stream. Within the pipe element 18 the air stream loaded with ice particles is admixed as required with water which has also been suitable cooled and as required mixed with antifreeze or cleanser, for clearing the hose 1, and corrosion inhibitor.

The high pressure mixture of air, ice particles and optionally water is conveyed along the hose 1 to the nozzle whence it is discharged at the surface to be cleansed of its contamination. Provided that due precautions have been made to preserve the low temperature of the ice particles, such as by suitable lagging of the auger and pipe elements and hose, the particles reaching the surface will be sufficiently hard and sharp and particularly by virtue of the air pressure will have sufficient kinetic energy as to dislodge contaminants from the surface in essentially the same way as does sand in a conventional blast cleaning operation. Unlike sand, however, the ice particles will melt sooner or later so that the removal of the dislodged contaminants becomes relatively easily effected by filtration from the water.

It will be understood from the description of the charging chamber 2 that as each compartment defined by an adjacent pair of blades 7 moves away from the inlet opening 8, another such compartment takes its place so that while ever the rotor is turning and ice is being fed to the chute 3, a continuous supply of ice will be presented to the auger. If, in spite of the control of the speed of both the auger and of the rotor, ice is presented to the auger at a faster rate than it can advance towards the hose 1, so that a compartment still contains ice after it has passed the opening 9, the remaining ice is discharged from the opening 10 into chute 22. The material discharged from the chute 22 is conveniently returned to the ice making machine.

Again, if ice is produced by the ice making machine at a faster rate than can be accommodated by the passage of successive empty compartments under the chute 3, excess ice will be directed away from the charging chamber and returned again to the ice making machine rather than to interrupt the flow of ice through the chute which could result in the particles sticking together.

When sand is used as an abradant in blast cleaning dust from fine particles can cause a significant problem, and one of the objects of introducing water into the fluid stream is to eliminate dust. It is likely in the operation of the present invention that dust will not present a problem and it may not be necessary to introduce water, but the apparatus described provides the facility for introducing water if required. Whilst the invention has a particular application in treating surfaces contaminated with radioactive substances, it is also of great value in the cleansing of buildings on account of the absence of dust, the reduced damage to the surface below the contaminant layer, and the fact that the spent particles of the abradant melt at ambient temperature and can readily be washed away down existing drains.

Whilst the invention has been described above as using ice as the abradant, it is to be understood that the ice could be replaced by other frozen liquid provided that the solid form is sufficiently abrasive and melts at ambient temperature.

As an alternative to propelling the particles in a fluid stream, they may be propelled mechanically, for example by the use of a centrifugal bladed-wheel blasting machine of known type. In this event it is preferable that a fluid stream be projected at the surface alongside or following the propelled particles in order to rinse away dislodged contaminants.

I claim:

1. Apparatus for removal of contaminants from a surface with particles of ice carried in a fluid stream, comprising:

means for producing particles of ice, auger means for introducing the particles into a fluid stream, and means for conveying the stream to the surface, characterized in that the apparatus further comprises:

transfer means arranged between the ice producing means and the auger means, said transfer means comprising a fixed cylindrical shell having an inner surface, and a rotor arranged for rotation within the fixed cylindrical shell, the rotor having a plurality of radial vanes extending to the inner surface of the shell so that neighboring vanes define with a portion of the shell a compartment which moves with the rotor from an upper position to a lower position, and the shell having first and second openings, the first opening being below the ice producing means whereby ice may fall from said ice producing means directly into successive compartments at an upper position, and said second opening being above the auger means whereby ice may fall from each successive compartment at a lower position directly into the auger means; and the shell of the transfer means has a third opening, after the second opening in respect to the direction of rotation of the rotor, said third opening providing for the discharge of ice from any compartment not totally emptied at the second opening.

2. Apparatus for removal of contaminants from a surface with particles of ice carried in a fluid stream, comprising:

means for producing particles of frozen water, transfer means arranged immediately below the means for producing particles of frozen water, said transfer means comprising a fixed cylindrical shell having an inner surface, and a rotor arranged for rotation within the fixed cylindrical shell, the rotor having a plurality of radial vanes extending to and sealingly engaging the inner surface of the shell so that neighboring vanes define with a portion of the shell a sealed compartment which moves with the rotor from an upper position to a lower position, and the shell having an upper opening at said upper position and immediately below the means for producing particles of frozen water so that said particles of frozen water fall from said means for producing directly into successive compartments at said upper position, and a lower opening at said lower position which provides that said particles of frozen water fall from each successive compartment at said lower position, auger means having an inlet portion positioned directly below said lower opening in said shell for receiving said particles of frozen water form said lower opening in said shell, and an outlet portion end to which said particles of frozen water are conveyed by said auger means, a chamber into which the outlet portion of the auger opens;

a fluid inlet adjacent the outlet portion of the auger and leading to said chamber; and means for supplying fluid at high pressure through said fluid inlet to said chamber to carry the particles of frozen water through the chamber to a nozzle located remotely of said outlet portion of the auger.

3. Apparatus according to claim 2; wherein each said radial vane forms a pressure seal with the inner surface of said shell.

4. Apparatus according to claim 2; further including means for adding water for mixing with said stream.

5. Apparatus according to claim 4; wherein said water is mixed with at least one of (a) antifreeze, and (b) corrosion inhibitor prior to supplying said water to said fluid stream.

6. Apparatus according to claim 2; wherein said fluid stream includes air, and said apparatus includes means for supplying air to said fluid stream.

7. Apparatus according to claim 6; further including means for cooling and drying said air prior to supplying said air to said fluid stream.

8. Apparatus according to claim 2; wherein said means for conveying includes a nozzle for supplying said fluid stream at a pressure in the range from 10 to 250 psig.

9. Apparatus according to claim 8; wherein said nozzle supplies said fluid stream to the surface at a pressure in the range between 20 psig and 160 psig.

* * * * *